US005778741A

United States Patent [19]

Batten

[11] Patent Number: 5,778,741

[45] Date of Patent: Jul. 14, 1998

[54] STATIONARY KEY MOUNTING IN FASTENER TOOL

[75] Inventor: Ronald W. Batten, Torrance, Calif.

[73] Assignee: Fairchild Holding Corporation, Chantilly, Va.

[21] Appl. No.: 650,381

[22] Filed: May 20, 1996

[51] Int. Cl.[6] ..... B25B 21/00

[52] U.S. Cl. ..... 81/56; 81/57.14

[58] Field of Search ..... 81/54–57, 57.14, 81/57.3, 13

[56] References Cited

U.S. PATENT DOCUMENTS

| | | | |
|---|---|---|---|
| 4,538,483 | 9/1985 | Batten | 81/56 |
| 4,721,022 | 1/1988 | Batten | 81/56 |
| 5,109,735 | 5/1992 | Hart | 81/55 X |
| 5,305,666 | 4/1994 | LaTorre | 81/55 |
| 5,553,519 | 9/1996 | Pettit, Jr. | 81/56 |

*Primary Examiner*—D. S. Meislin
*Attorney, Agent, or Firm*—Robert E. Strauss

[57] ABSTRACT

There is disclosed a method for the assembly of an aerospace fastener system of a torque limiting, frangible collar nut and pin in a non-interference fit application wherein the pin develops increased frictional resistance to rotation with increased torque loading applied to the fastener. In the method, the nut is run up on the pin while rotation of the pin is retarded by a key which has a limited rotational movement and which is restrained against rotation by a resilient spring force. The method is practiced with an improved L-head for a rotationally driven tool in which the key holder of the L-head has a limited degree of rotational moveability which is resilient restrained by a spring link which includes a cable which is passed about a stationary drum to provide a dampening of the spring force. The invention greatly extends the useful life of keys as the torsional loads transmitted to the keys are held within safe limits.

20 Claims, 3 Drawing Sheets

STATIONARY KEY MOUNTING IN FASTENER TOOL

BACKGROUND OF THE INVENTION

1. Field of Invention

This invention relates to a holder for a key and, in particular, to a holder for a key used in tools for the attachment of aerospace fasteners which minimizes or prevents bey breakage.

2. Brief Statement of the Prior Art

A particular fastening system has been developed for use in the aerospace industry, which employs frangible fasteners comprising a pin with a nut member having a threaded collar and a wrenching ring separated by a notched section that provides a predetermined limiting torque which when exceeded, permits the wrenching ring to shear from the threaded collar, leaving the latter in place at a precise and predetermined tensile loading on the pin. Often, the threaded collar has an upset portion usually a slightly elliptical shape to provide a frictional spring lock to prevent the fastener from spinning off the bolt in the event that the residual tension on the fastener is lost.

These threaded fasteners are used both in loose and interference fit applications. In loose fit applications it is often difficult to work from both sides of the workpiece, and it has been the practice to use a drive tool to apply the fasteners which has a non-rotatable key that is inserted into a broached keyway in the end of the pin to hold the pin stationary while the threaded collar is applied.

In my prior U.S. Pat. No. 4,538,483, I disclose an improved wrenching tool in which a key member is provided with a distal groove that is received in a key holder which has a detent ball that is mounted in a lateral bore and that engages the distal groove of the key member. The key holder is slidably received in a central bore of the rotationally driven socket member which has an interior ball cavity. When the ball cavity in the socket member is aligned with the lateral groove of the key holder, the detent ball can move outwardly, releasing the key and permitting its removal. In my prior application, Ser. No. 823,009, now U.S. Pat. No. 4,721,022, I disclose a release mechanism in the drive tool which precisely locates the detent ball for release of the key.

The pins are usually applied with sealants which also lubricate the undersurface of the head of the pin during the initial tightening of the collar against the workpiece. Consequently, the key must often absorb the entire applied torque, until the sealant is extruded sufficiently for the undersurface of the head of the pin to grab against the workpiece. A the limiting, shear torque for the fasteners usually exceeds the shear strength of the pins, it is not uncommon for the keys to shear before the limiting stress on the nut fastener is reached, and the wrenching ring is separated from the locking collar.

OBJECTIVES OF THE INVENTION

It is an objective of this invention to minimize or prevent breakage of the keys used to immobilize fastener pins during their installation.

It is a further objective of this invention to provide an assembly method for a pin and nut fastener by retarding rotation of the pin with a key which is resiliently restrained against rotation while applying an escalating torque to said nut to tighten said assembly.

It is an additional objective of this invention to provide the aforesaid assembly method for the application of torque limited locking collars to pins in an aerospace fastener system.

It is also an objective of this invention to provide, in a rotationally driven fastener tool which has a stationary key, a tolerance in the mounting of the key in the key holder to permit a limited degree of rotation of said key within the holder.

It is likewise an objective of this invention to provide, in the aforesaid fastener tool, a spring link between the key and the body of the tool to provide a resilient restraint of the key within its limited degree of rotation in the key holder.

It is a still further objective of this invention to provide the aforesaid resilient mounting of a key in a key holder of a L-head accessory for a rotationally driven tool.

Other an related objectives will be apparent from the following description of the invention.

BRIEF DESCRIPTION OF THE INVENTION

The invention comprises a method for the assembly of an aerospace fastener system of a torque limiting, frangible collar nut and pin in a non-interference fit application wherein the pin develops increased frictional resistance to rotation with increased torque loading applied to the fastener. In the method, the nut is run up on the pin while rotation of the pin is retarded by a key which has a limited rotational movement and which is restrained against rotation by a resilient spring force. The method is practiced by the improved L-head for a rotationally driven tool in which the key holder has a limited degree of rotational moveability which is resilient restrained by a spring link which includes a cable which is passed about a stationary drum to provide a dampening of the spring force.

BRIEF DESCRIPTION OF THE DRAWINGS

The invention will be described with reference to the figures of which.

DESCRIPTION OF PREFERRED EMBODIMENT

Figure 1:
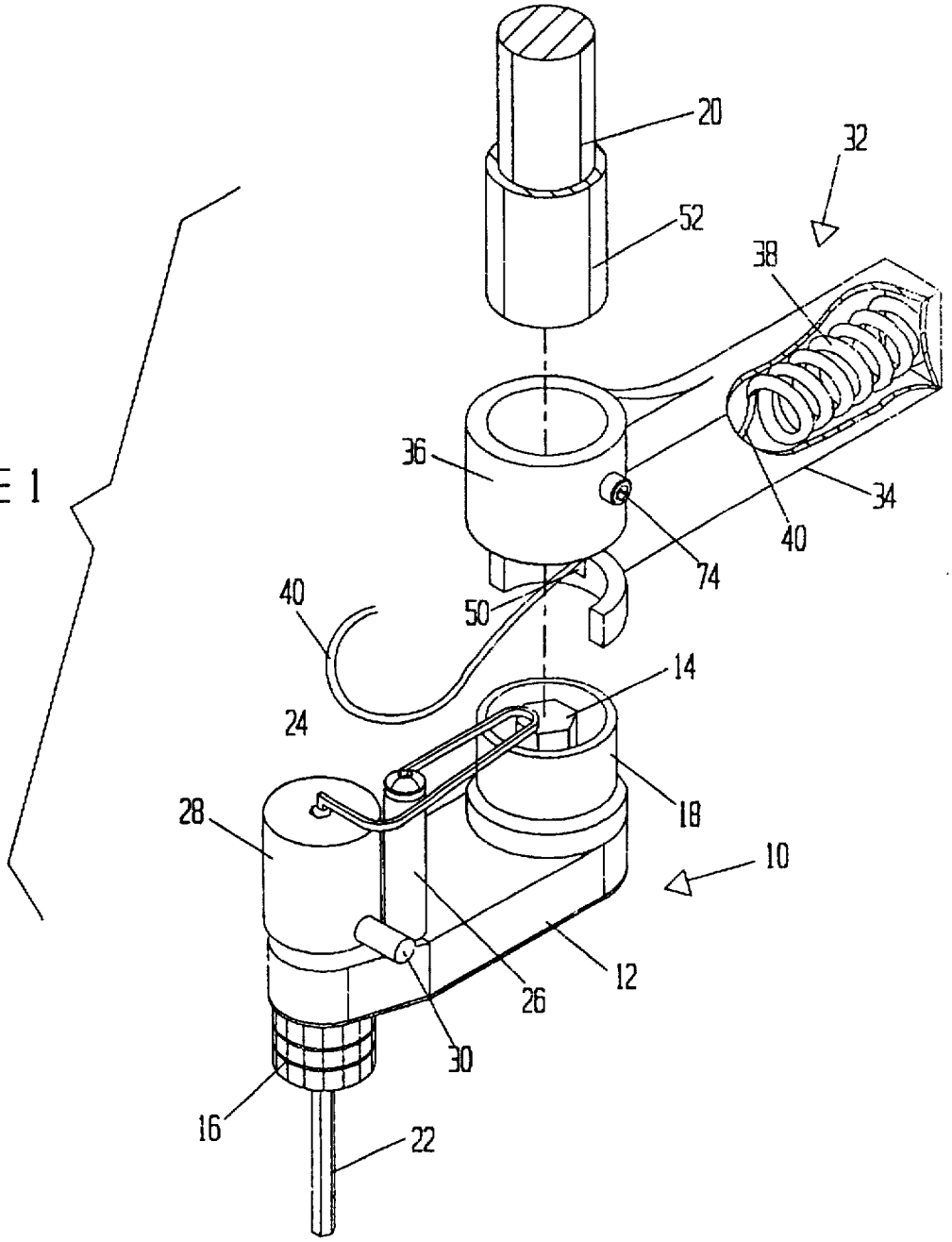
FIG. 1 is an exploded perspective view of the L-head tool accessory modified in accordance with the invention.

Referring to FIG. 1, the invention is illustrated in an exploded view of its application to a L-head 10 for a rotationally driven wrenching tool typical of those used in the aerospace industry. As there illustrated, the L-head 10 has a housing 12 which contains a gear train (not shown) connecting between the input shaft 14 and an output shaft on which is supported socket 16. In many applications, the socket 16 will be one of a number of interchangeable sockets. The housing 12 has a cylindrical boss 18 on its input end, which surrounds the input shaft 14 which is engaged by the output shaft 20 of the rotationally driven wrenching tool (tool not shown).

The L-head 10 is provided with a rotationally restrained key 22 which is received in a receptacle in the end of an aerospace fastener pin, described hereinafter. The key 22 is axially slidably received in a key holder 28 and is biased toward the socket 16 by a resilient spring arm 24 which is supported on a post 26 carried on the housing 12.

The key holder 28 is provided with a radial post 30 which engages against the spring support post 26, thereby restraining the key holder 28 against free or unlimited rotation.

The L-head 10 is provided with a handle 32 which also functions as a housing for spring 34. The handle 32 has a cylindrical sleeve 36 at one end that is received over the end of sleeve 52 of the wrenching tool, and is secured thereto by a set screw 74. The handle 32 is hollow, as shown in the partial section, and a conventional tension coil spring 34 is received in the handle 32, with one end secured to the end wall of the handle 32, and the opposite end 38 attached to a cable 40 which extends outwardly from the handle 32. The cable 40 exits the handle 32 through a slot 50 located beneath the sleeve 36. As described hereinafter, this cable 40 is played in one revolution about the sleeve 52 of the rotationally driven wrenching tool and has its free end secured to the key holder 28 in the manner described in greater detail with reference to FIG. 2.

Figure 2:
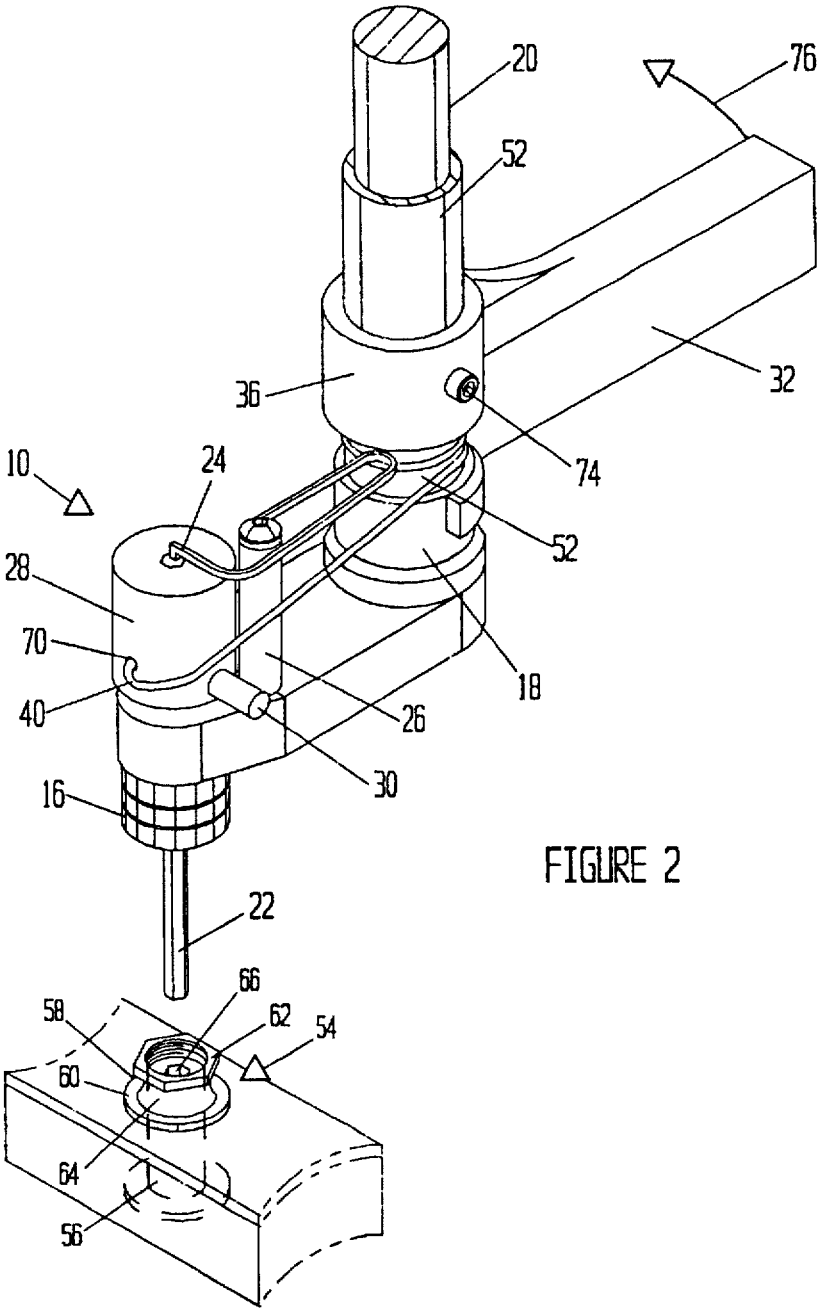
FIG. 2 is a perspective view of the assembled L-head tool accessory of the invention.

Referring now to FIG. 2, the L-head 10 as modified by the invention is illustrated in a position above a conventional aerospace fastener 54 which comprises a pin 56 that is threadably received in a nut fastener 58. The nut fastener 58 has a collar 60 which is secured to a wrenching ring 62 by a frangible transition 64. The pin 56 has a hexagonally flatted receptacle 66 in its threaded end which receives the key 22. The key 22 is shown in an extended position and the key is axially slidably received within the key holder 28 of the L-head 10. The key 22 is placed in the receptacle 66 of the pin 56 and the socket 16 is placed over the wrenching ring 62 and a rotational force is applied to the socket 16 through the L-head gear train within the L-head housing 10.

The cable 40 extends through the slot 50 in the handle 32 and is wrapped with one revolution about the end of the sleeve 52 of the wrenching tool, and then extends to a secured attachment to the key holder 28 on the L-head 10. For this purpose, the key holder 28 has an aperture 70 which receives the end 72 of the cable 40 in a permanent attachment. The cable 40 thus provides a resilient restrain to rotation of the key holder 28, and key 22.

As the nut fastener 58 is advanced on the pin 56, the key 22 resists torque transmitted to the pin 56 during run up of the nut fastener 58. When the nut fastener 58 begins to tighten on the assembly, however, the increased torque applied to the pin 56 will cause rotation of the key 22, against the resilient bias of the spring 34 and cable 40.

The maximum rotational movement of the key holder 28 and key 22 is limited by the radial post 30 which abuts against the spring support post 26 thereby providing a rotational movement of approximately 270 to 300 degrees. In practice, the key holder has been observed to rotate approximately 30 to 45 degrees before the frictional forces between the head of the pin and the workpiece frictionally restrain further rotation of the pin 56.

Figure 3:
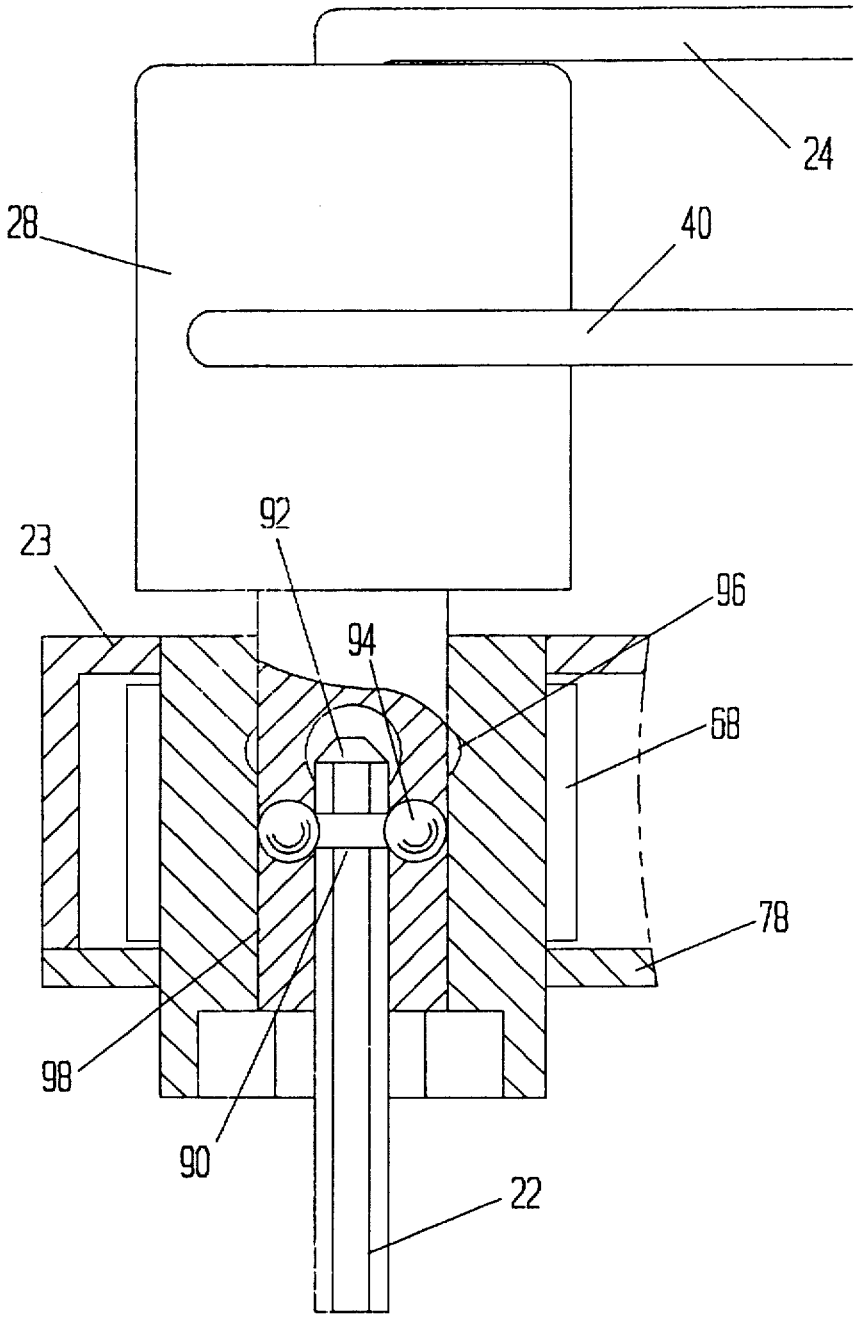
FIG. 3 is a sectional view along lines 3–3' of FIG. 2.

Referring now to FIG. 3, there is illustrated a sectional view along line 3–3' of FIG. 2. The key holder 28 is slidably received in the surrounding output gear 68 of the gear train within the housing 12 of the L-head 10. Preferably the upper end of the key holder 28 is in the form of a cylindrical drum for attachment of cable 40, as previously described. The housing 12 is closed with cover plate 78. The lower end 80 of the output gear 68 (driven member) receives a socket 16 which is rotationally secured to the output gear 68. The key holder 28 has a central passage 23 which receives the key 22. As disclosed in my prior U.S. Pat. No. 4,538,483, the key 22 has an annular groove 90 adjacent its inner end 92 which receives detent balls 94 thereby interlocking the key 22 within the key holder 28. An annular groove 96 is provided on the inner wall 98 of the output gear so that when the annular groove 90 of the key is aligned with the annular groove 96 of the output gear 68, the detent balls 94 can move laterally, releasing the key 22.

The use of the cable and wrapping of the cable around the stationary sleeve of the rotational driver has a number of beneficial advantages. First, the necessary spring force is reduced by a factor of 10 for every revolution of the cable. In the illustrated embodiment in which the cable is coiled in one complete revolution about the stationary sleeve, the tension on the cable is ten times the spring force. Additionally, the rotational position of the handle is adjustable within the assembly. The set screw 74 can be loosened and the handle 32 can be rotated in a direction to increase or decrease the length of the cable which is coiled about the stationary sleeve. To illustrate, if the handle is rotated 90° in the direction of the arrow 76, the tension applied to the cable by the spring can be increased by 25 percent. Similarly, a rotation in the opposite direction of 90° will reduce the tension on the cable by a factor of 25 percent. The frictional drag and the stretching of the cable in response to torques applied to the key also provide a dampening of the spring response and a delay in the rotational response of the key holder to the applied forces.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A method for the assembly of a pin and nut fastener in a non-interference fit application wherein the pin exhibits frictional resistance during run-up of the nut and develops increased frictional resistance to rotation of the nut with increased torque loading applied to the fastener, the improvement comprising:

a. running the nut on the pin while applying a rotational restraining force to the pin sufficient to overcome the frictional resistance of the fastener to the run-up of the nut;

b. applying an escalating torque to said nut to tighten said assembly, while applying a resilient restrain to rotation of said pin, thereby permitting a limited degree of rotation of said pin; and c. applying a final tightening torque to the nut.

2. The method of claim 1 including the step of applying a wrenching tool to the pin of said fastener to restrain said fastener during application of said nut.

3. The method of claim 2 including the step of inserting a key into a key socket on the nut end of said fastener to apply said resilient restrain to rotation of said pin.

4. The method of claim 3 including the step of selecting, as said nut a torque limiting nut with a frangible torquing collar which severs from said nut upon the application of a predetermined limiting torque.

5. The method of claim 4 including the step of selecting a torque limiting nut having a limiting torque which exceeds the torque shear strength of said key.

6. In a rotational wrenching tool which comprises a driven member having a distal socket rotationally mounted on said tool, said distal socket having a central bore in which is slidably received a key member holder and including a rotational stop limiting rotation of said key member holder, the improvement which comprises:

d. a tolerance between said key member holder and said rotational stop to permit at least a limited degree of rotation of said key member within said bore; and e. a spring captured between said key member holder and said tool to provide a resilient rotational restrain of said key member and holder within said degree of rotation.

7. The rotational wrenching tool of claim 6 where in said rotational wrenching tool is an L-head having a tool housing containing a gear train with an input shaft of one end thereof which is connected by said drive train to said driven member which is located at the opposite end of said housing.

8. The rotational wrenching tool of claim 7 wherein said key member has a flatted end which projects through said socket and the opposite end of said key member is received in one end of said key member holder and is rotationally restrained by said key member holder.

9. The rotational wrenching tool of claim 8 wherein said key member holder has a drum on its end opposite said one end which receives said key member.

10. The rotational wrenching tool of claim 8 including a cable with one end thereof received about said drum and the opposite end thereof secured to said spring.

11. The rotational wrenching tool of claim 10 wherein said spring is a tension coil spring with one end thereof attached to said opposite end of said cable and the other end thereof fixedly attached to said tool housing.

12. The rotational wrenching tool of claim 11 including a stationary cylindrical sleeve carried on said tool housing with said cable looped about said cylindrical sleeve.

13. The rotational wrenching tool of claim 11 wherein said stationary cylindrical sleeve surrounds said input shaft.

14. The rotational wrenching tool of claim 11 wherein said rotational stop is a post fixedly carried on said housing and including an arm radially projecting from said drum into engagement against said post, thereby providing a limit to the degree of rotatability of said drum and key member holder.

15. The rotational wrenching tool of claim 7 including a handle carried on said housing.

16. In an L-head fitting for an aerospace rotational wrenching tool which includes an L-head housing, a gear train within said housing having an input shaft located at on one end of said housing and a driven member rotationally mounted on the opposite end of said housing with a socket carried thereon which has a central bore in which is axially slidably received a key member holder which has a receptacle on one end thereof that receives and rotationally restrains a key member the improvement in said L-head fitting which comprises:

g. a drum affixed to said key member holder;

h. a cable with one end thereof received about said drum; and i. a spring having one end attached to the end of said cable opposite said one end thereof, with the opposite end of said spring fixedly secured to said housing.

17. The L-head fitting of claim 16 wherein said spring link is a tension coil spring.

18. The L-head fitting of claim 17 including a stationary cylindrical sleeve carried on said tool housing with said cable looped about said cylindrical sleeve.

19. The L-head fitting of claim 18 wherein said stationary cylindrical sleeve surrounds said input shift.

20. The L-head fitting of claim 16 including a post fixedly carried on said housing and including an arm radially projecting from said drum into engagement against said post, thereby providing a limit to the degree of rotatability of said drum and key member.

* * * * *